US005104248A

United States Patent [19]

Tezuka et al.

[11] Patent Number: 5,104,248

[45] Date of Patent: Apr. 14, 1992

[54] PRINT WHEEL SHIFT MECHANISM FOR USE WITH A MINIATURE PRINTER

[75] Inventors: Chikao Tezuka; Yukihiro Hanaoka; Hiroyuki Nakayama, all of Shiojiri, Japan

[73] Assignee: Seiko Epson Corporation, Tokyo, Japan

[21] Appl. No.: 557,360

[22] Filed: Jul. 25, 1990

Related U.S. Application Data

[60] Division of Ser. No. 186,844, Apr. 27, 1988, Pat. No. 4,948,273, which is a continuation of Ser. No. 781,593, Sep. 30, 1985, Pat. No. 4,787,761.

[30] Foreign Application Priority Data

May 13, 1985 [JP] Japan ..... 60-100778

[51] Int. Cl.[5] ..... B41J 25/24

[52] U.S. Cl. ..... 400/257; 400/152; 101/93.18

[58] Field of Search ..... 400/139, 140, 141, 141.1, 400/142, 144, 144.1, 144.2, 144.3, 145, 145.1, 145.2, 148, 152, 257; 101/93.13, 93.14, 93.15, 93.16, 93.17, 93:18, 93.19, 93.20, 93.21, 93.24, 93.25, 93.37, 93.38, 93.39, 93.40

[56] References Cited

U.S. PATENT DOCUMENTS

| | | | |
|---|---|---|---|
| 138,437 | 4/1873 | Richardson | 346/139 D |
| 2,606,092 | 8/1952 | Rich | 346/139 D |
| 2,913,091 | 11/1959 | Neumann | 400/332.4 X |
| 3,279,576 | 10/1966 | Howard | 101/93.16 X |
| 3,405,794 | 10/1968 | Means | 101/93.17 |
| 3,442,365 | 5/1969 | Ragland, III et al. | 400/144.3 |
| 3,651,916 | 3/1972 | Becchi | 101/93.17 X |
| 3,926,061 | 12/1975 | Paulson | 74/22 R |
| 4,037,707 | 7/1977 | Ku et al. | 400/144.1 |
| 4,410,289 | 10/1983 | Koike et al. | 400/185 |
| 4,437,776 | 3/1984 | Hirano | 400/145.2 X |
| 4,437,777 | 3/1984 | Hori | 101/93.16 |
| 4,443,123 | 4/1984 | Ono et al. | 400/146 X |
| 4,534,655 | 8/1985 | Mori et al. | 101/93.17 |
| 4,787,761 | 11/1988 | Tezuka et al. | 400/145.2 |

FOREIGN PATENT DOCUMENTS

| | | | |
|---|---|---|---|
| 182466 | 11/1982 | Japan | 400/145.2 |
| 20486 | 2/1983 | Japan | 400/257 |
| 58-87057 | 5/1983 | Japan | 400/328 |
| 58-107379 | 6/1983 | Japan | 400/328 |
| 59-29166 | 2/1984 | Japan | 400/146 |

*Primary Examiner*—David A. Wiecking
*Attorney, Agent, or Firm*—Blum Kaplan

[57] ABSTRACT

In a miniature printer including a carriage for motion along a path in linear reciprocating directions having at least one cam surface, a frame including a projection adjacent to the path and a print wheel having at least two levels of print type, a mechanism for shifting the position of the print wheel between the different print type levels. The mechanism is coupled to the print wheel and responsive to contact with the projection as the mechanism travels by the projection in shifting the print wheel position through engagement with the cam surface.

6 Claims, 9 Drawing Sheets

FIG. 6
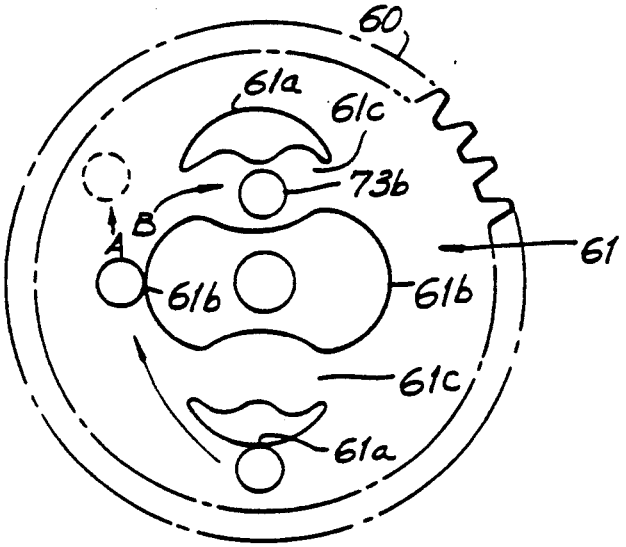
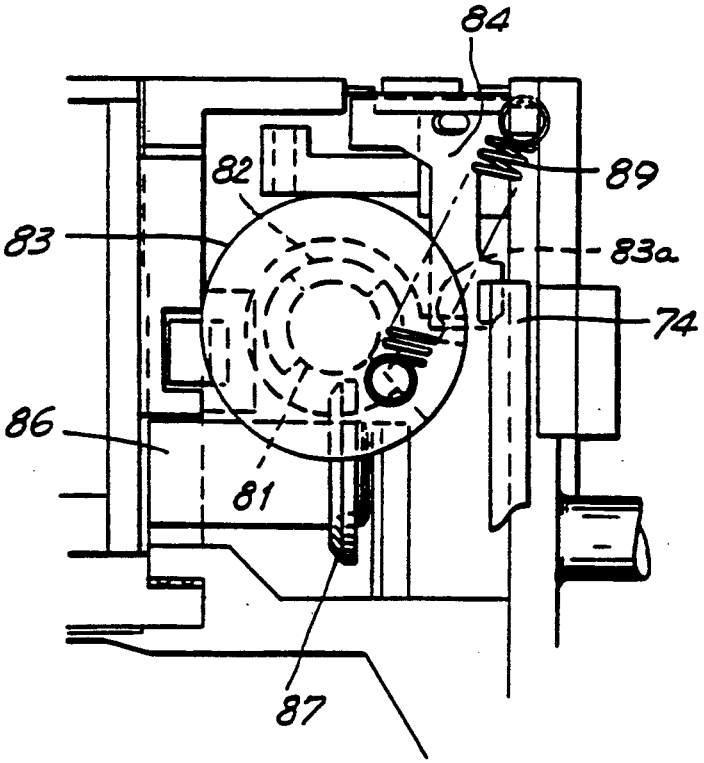
FIG. 7

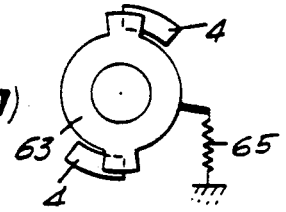
FIG. 9(a)
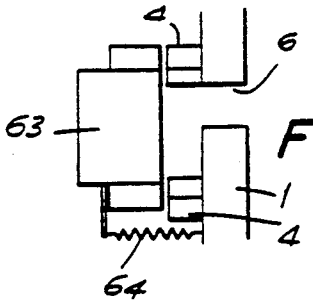
FIG. 9(a')
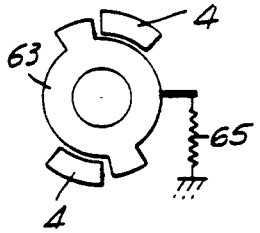
FIG. 9(b)
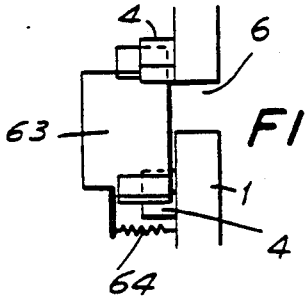
FIG. 9(b')
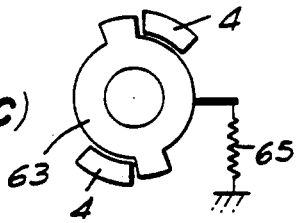
FIG. 9(c)
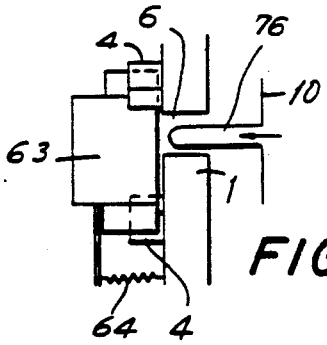
FIG. 9(c')
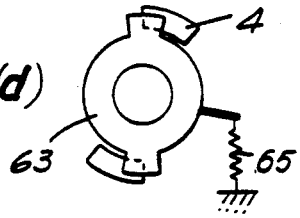
FIG. 9(d)
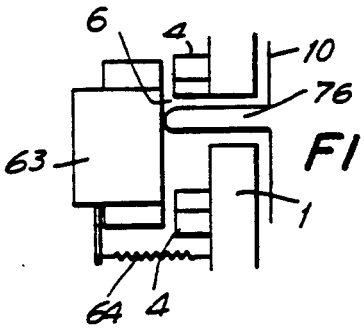
FIG. 9(d')

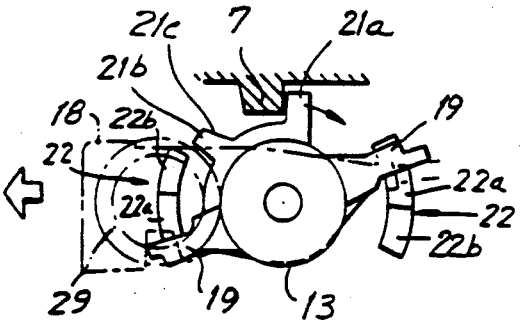
FIG. 10(a)
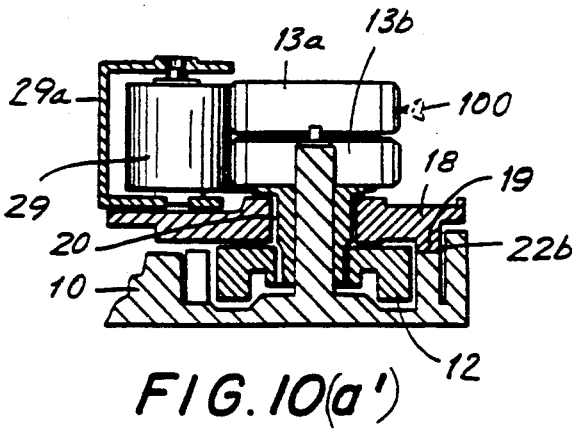
FIG. 10(a')
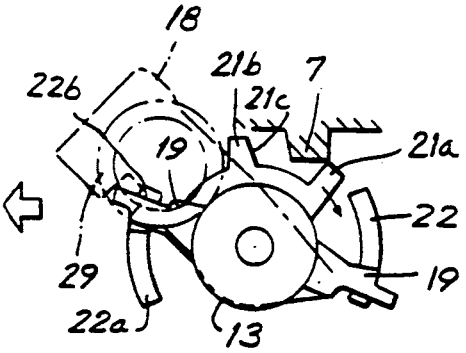
FIG. 10(b)
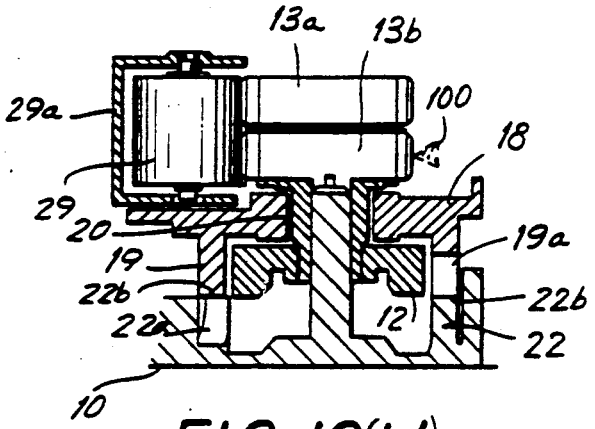
FIG. 10(b')
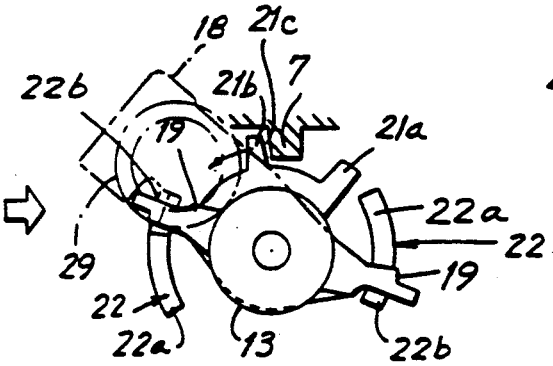
FIG. 10(c)
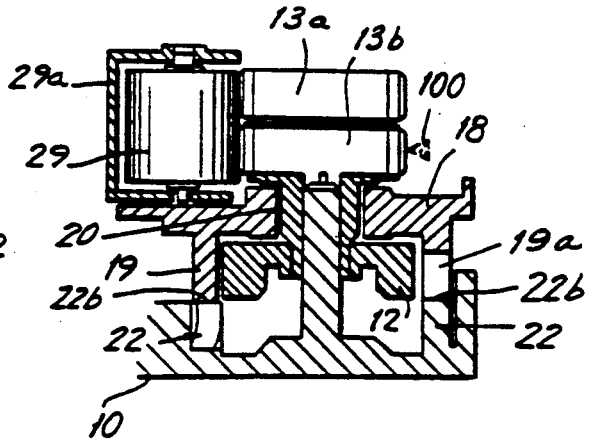
FIG. 10(c')

PRINT WHEEL SHIFT MECHANISM FOR USE WITH A MINIATURE PRINTER

This is a division of application Ser. No. 07/186,844, filed Apr. 27, 1988, now U.S. Pat. No. 4,948,273 which is a continuation of application Ser. No. 06/781,593, filed Sept. 30, 1985 which has issued as U.S. Pat. No. 4,787,761 on Nov. 29, 1988.

BACKGROUND OF THE INVENTION

The present invention relates to printers of a small size, e.g., to miniature printers. More particularly, the invention relates to such printers in which a mechanism is employed for selecting print characters as a carriage is moved along a print line and then is returned to its home position.

Miniature printers are often used in desktop calculators, electronic cash registers, and the like, to move a print wheel to a desired print position in front of a piece of paper which is to be printed on, to rotate the wheel to select a desired print character, and then to print the character. In general, printers of this kind have a rotating mechanism for selecting print characters which is independent of the mechanism that is used for moving the print wheel along the print line. The structure of the printer is therefore complicated and is difficult, if not impossible, to manufacture in the small size which has been demanded.

An apparatus is disclosed in the U.S. Pat. No. 4,437,776 which attempts to solve this problem by using a drive in which a worm meshes with a worm gear that is made integral with the print wheel. A rack is moved in and out of engagement with the worm gear so that movement of the print wheel in rotation and in translation are accomplished in one mechanism. Another apparatus which addresses the problem is disclosed in Japanese Laid-Open Patent No. 107379/1983, where a worm gear which is integral with a print wheel meshes with two worms which rotate at different angular velocities, simultaneously rotating the wheel and moving it along the print line. The apparatuses of the foregoing use greatly simplified mechanisms in an effort to solve the aforementioned problem. However, in the apparatus of the U.S. patent, when the rack comes into and out of engagement with the worm gear, their addendums abut against each other so that precise operation is not feasible. In addition, a large amount of electric power is consumed for moving the print wheel along the print line because the mechanism which returns the print wheel to its original state uses a tension spring against which the drive motor must work. In the apparatus of the Japanese laid-open patent the mechanism moves the print wheel along the print line by using the difference between two angular worm drive velocities, and a long time is necessarily consumed in returning the print wheel to its original angular position. Also the drive must be reversed to return the print wheel to its original angular position. Hence, the device is not well-suited for high-speed printing. Conventional miniature printers also undesirably require additional power for shifting the print wheel between different levels of print type.

SUMMARY OF THE INVENTION

Shifting of the print wheel vertically, relative to the print line, for changing type groups, is accomplished by means of a print wheel shifting plate which is rotatably mounted beneath the print wheel on the carriage. This shifting plate is turned by a cam surface on the frame as the carriage returns to its starting position. As it turns, the lifting plate moves on lifting cam surfaces on the carriage, raising the print wheel. The motion is reversed to lower it again.

It is an object, therefore, of the invention to provide a compact mechanism for use in a miniature printer.

It is still an other object of the invention to provide a simple printer mechanism for use in a miniature printer which is easily manufactured in small size.

It is a further object of the invention to provide a miniature printer which is precise in its operation.

It is still another object of the invention to provide a miniature printer which is economical in the use of electric power.

It is still a further object of the invention to provide a miniature printer which can be produced at a low cost.

It is yet another object of the invention to provide a printer having a shifting mechanism within the carriage for adjusting, with high degree of accuracy, the vertical position of the print wheel more efficiently.

It is still a further object of the invention to provide a printer in which the print wheel rolls as the characters are printed so as to form good, vivid printed images on the printing medium.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which:

FIG. 6 is a view of the cam on the rear of the timing gear of the printer;

FIG. 7 is a plan view of the paper-feed mechanism of the printer;

FIGS. 9(*a*), 9(*b*), 9(*c*) and 9(*d*) are plan views and FIGS. 9(*a'*), 9(*b'*), 9(*c'*) and 9(*d'*) are corresponding side views illustrating the operation of the return lever of the printer; and FIGS. 10(*a*), 10(*b*) and 10(*c*) are plan views and FIGS. 10(*a'*), 10(*b'*), 10(*c*) are corresponding side sectional views illustrating the manner in which the print wheel is shifted in the apparatus of the invention.

DETAILED DESCRIPTION OF THE INVENTION

Figure 1:
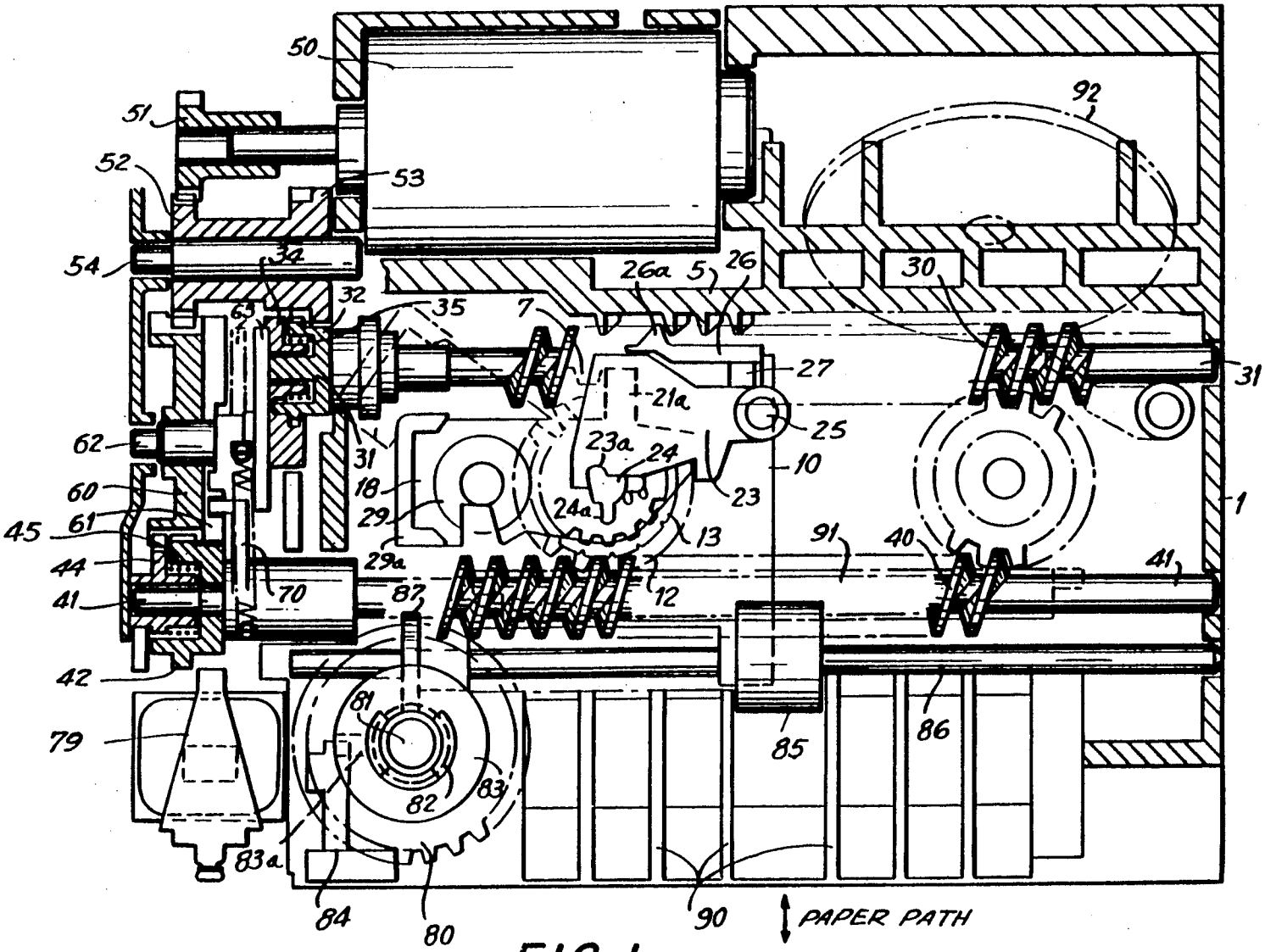
FIG. 1 is a top sectional view of a miniature printer fabricated in accordance with the teachings of the present invention.
Figure 2:
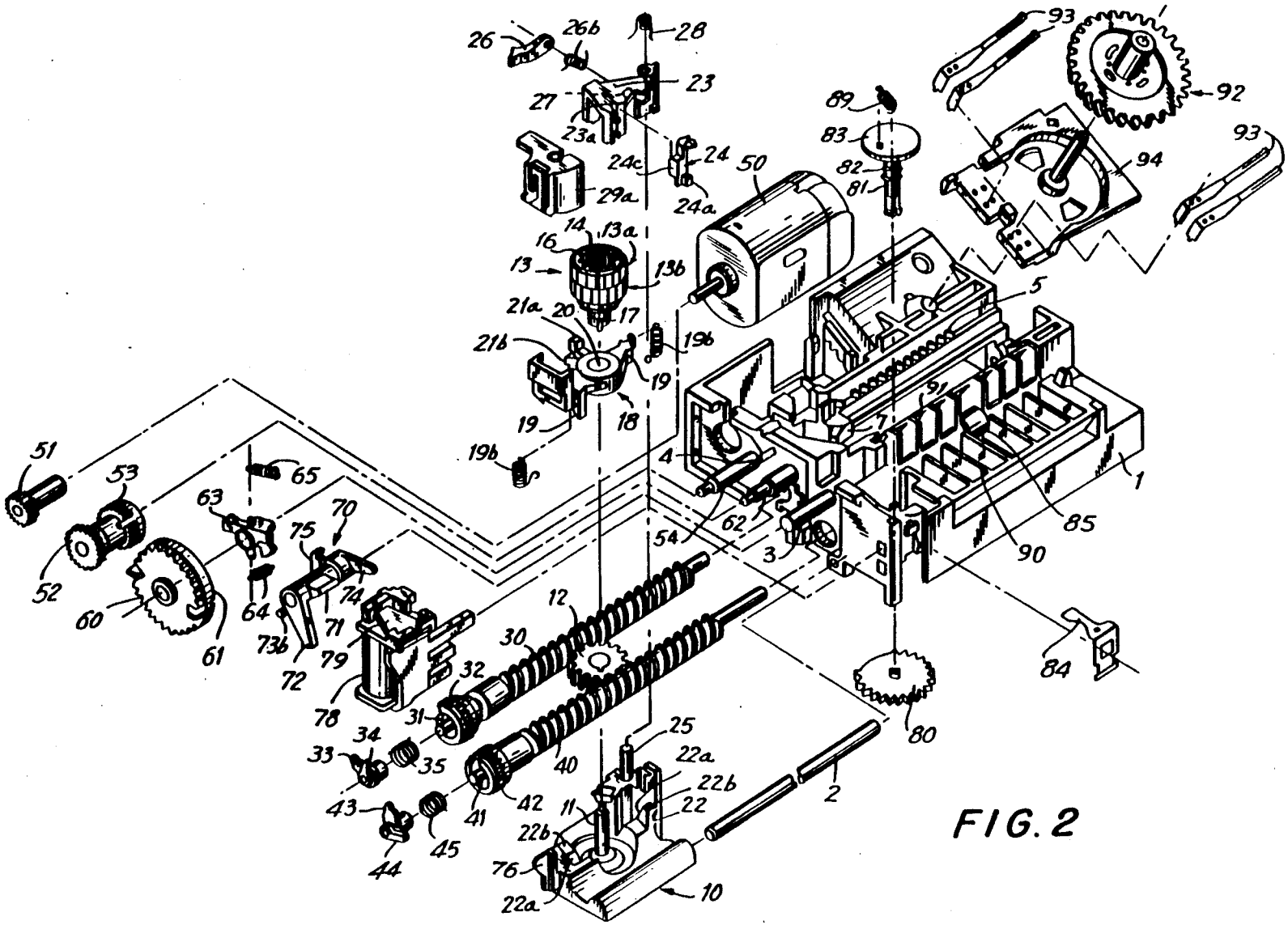
FIG. 2 is an exploded view of the printer of FIG. 1.
Figure 3:
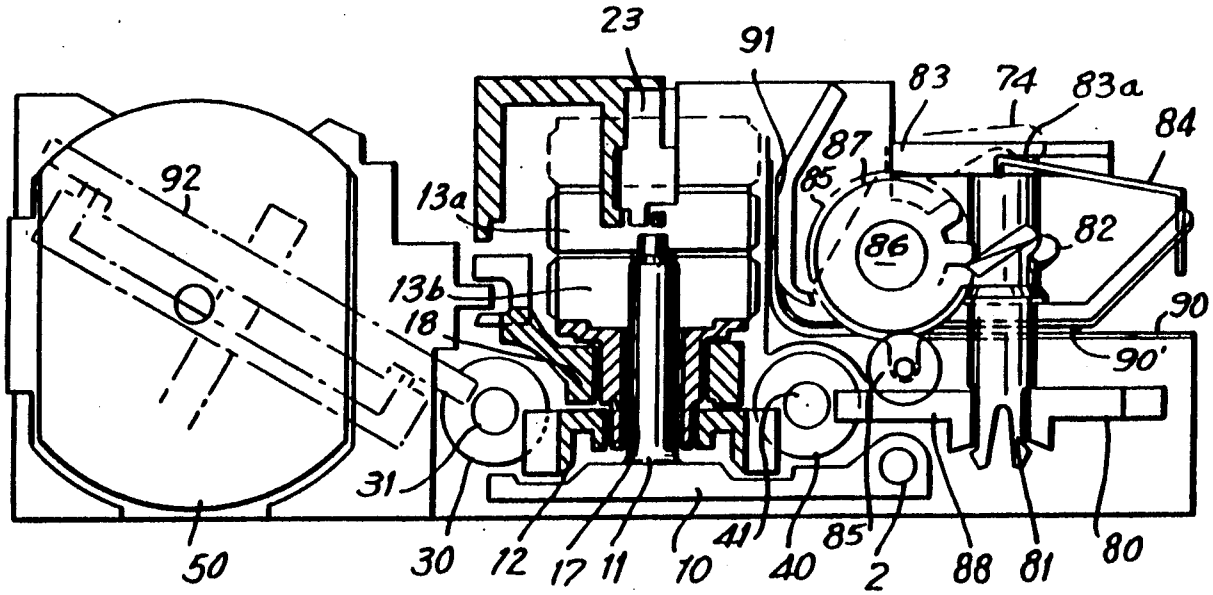
FIG. 3 is a sectional side elevational view of the printer.

The relationship of the main elements in the structure of a printer fabricated in accordance with the present invention are shown in plan view in FIGS. 1-3. Some details are better seen in later figures.

Figure 4:
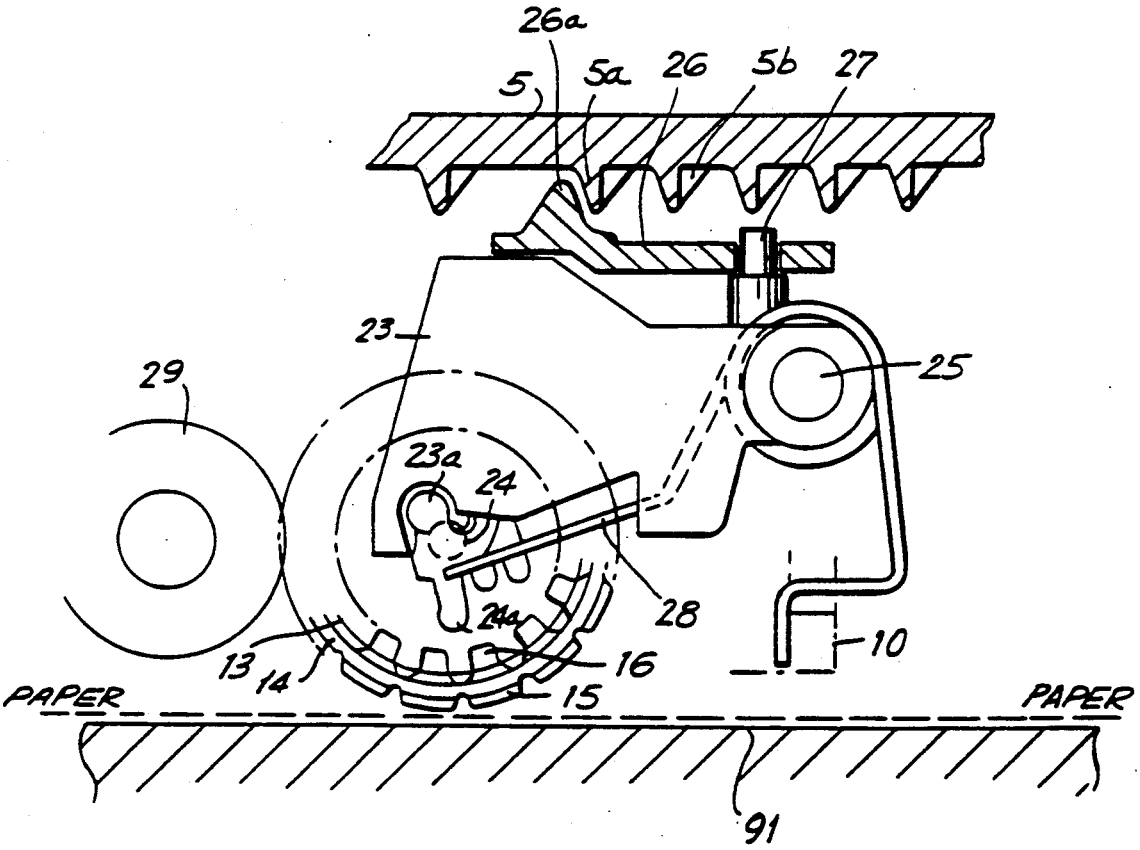
FIG. 4 is a plan view of the print wheel mechanism of the printer.

The printer has a frame 1 to which, as best seen in FIGS. 2 and 3, a guide rail 2 is firmly fixed. A carriage 10 is mounted so that it can move along a platen 91 while guided by guide rail 2. A print wheel, generally designated 13, is mounted on carriage 10 for travel back and forth in front of platen 91 (FIG. 2 and 4). The paper (not shown) to be printed on is supported between platen 91 and print wheel 13.

The line along which print wheel 13 moves in front of the platen 91 and at which characters and numbers may be printed is herein called the print line and is schematically represented in end view by pointer 100 in FIGS. 10(*a'*), 10(*b'*), and 10(*c'*). Paper is moved into printing position through paper groove 90' from a paper receiving surface 90 on frame 1 (FIGS. 1 and 3) by means of a paper roller 85.

The printer includes mechanisms for controlling the selection of characters which are carried at either one of two levels 13*a* and 13*b* on print wheel 13 for printing a selected character 15, for moving carriage 10 along platen 91, and for advancing paper upwards past the platen 91. The drive mechanism which couples rotational motion from a motor to perform these functions responds to the control mechanism to selectively control the operation of the various elements of the printer.

As shown in FIGS. 2 and 3, the printing mechanism includes a print wheel support shaft 11 which projects upwardly from the surface of carriage 10, A sleeve 17, which is loosely mounted for rotation on shaft 11, carries print wheel 13 fixed to its top end. Print wheel 13 has two levels, 13*a* for numbers and 13*b*, for symbols. A print wheel drive gear 12 is fixed to the bottom end of sleeve 17. Print wheel 13 is held so that it can be slid vertically by a print wheel shift lever 18 which is fitted loosely around sleeve 17 between print wheel 13 and gear 12. Shift lever 18 is plate-like in form and acts to bring either one of numeral wheel 13*a* or symbol wheel 13*b* into printing position at the print line. Shift lever 18 is provided with a hole 20 (FIGS. 2 and 10) through which sleeve 17 extends and with two protrusions 21*a* and 21*b* each of which is formed on a side of shift lever 18 and extends outwards radially relative to hole 20. First protrusion 21*a* has a portion which extends upwards, parallel to the axis of hole 20. Second protrusion 21*b* has at least one oblique surface 21*c*. As best seen in FIG. 10, two projections 19, both of which have downward inclined surfaces 19*a* that face in the same circumferential direction, depend, on opposite sides of shift lever 18, from its lower surface. Shift lever 18 rides on trapezoidal cam members 22, each of which has an upwardly inclined surface 22*a* and a horizontal top surface 22*b*. Cam members 22 are integral with carriage 20, on opposite sides of shaft 11, and have upward-facing inclined surfaces 22*a* which bear against the inclined surfaces of projections 19.

Each time that carriage 10 moves towards its home position (at the left, as viewed in FIG. 1), the side of projection 21*a* comes to bear against a protrusion 7 which is formed on frame 1 near the home position of the carriage (FIGS. 1, 2, and 10). As a result, shift lever 18 is swung to the right (clockwise in FIGS. 10(*a*) and 10(*b*)). When the carriage movement is reversed, second protrusion 21*b* strikes fixed projection 7 swinging print wheel shift lever 18 back to the left (FIG. 10*c*). The rotations of shift lever 18 cause the sloping surfaces 19*a* of projections 19 to first ride up along inclined surfaces 22*a* and to then ride back down, being urged downwards by return springs 19*b* (FIG. 2). Shift lever 18 thus raises and lowers itself to position one or the other of print wheels 13*a* and 13*b* at the level of the print line.

Printing is accomplished by means of a hammer support lever 23 which is pivotally mounted on shaft 25 at one corner of carriage 10. Hammer support lever 23 extends horizontally above print wheel 13 and has a recess 23*a* located near the position at which the front end of the support lever meets the axis of rotation of print wheel 13. A type belt 14 carrying a plurality of print characters 15 FIG. 4; is fitted around print wheel 13 and carries print characters at both level 13*a* and level 13*b*. Each outwardly protruding print character 15 has a rearward projection 16 which extends inwardly from the rear surface of the belt. A curved portion 24*b* of print hammer 24 is mounted in hammer lever recess 23*a*. A portion 24*c* of hammer 24 extends downward within print wheel 13, being rotatable in the plane of the print wheel to bring its outward-extending hammer head 24*a* into contact with the rearward projection 16 of a selected type 15. A spring 28*a* holds print hammer 24 in recess 23*a* and rotates it in a counter-clockwise direction therein so that it is held off of the print line and facing towards rear protrusion 16. At the beginning of the printing process, as shown in FIG. 4, hammer 24 and hammer head 24*a* are in position to strike the protrusion 16 which is located on the rear surface of the print character 15 and which is about to arrive in position for printing.

For printing, hammer lever 23 is driven in rotation about shaft 25 and against the force of spring 28 by the application of force to a shaft 27 which is formed integrally with the lever and which projects laterally therefrom in a direction perpendicular to the direction of motion of the carriage. A pawl-like, rocking lever 26 is rotatably mounted on shaft 27. As carriage 10 moves forward, i.e. to the right in FIG. 1, a laterally-extending tip 26*a* on rocking lever 26 encounters the slanted first surface 5*a* of rack-like printing cam 5. Printing cam 5 is fixed to frame 1 and extends in the direction of movement of carriage 10. As carriage 10 moves to the right, hammer support lever 23 is driven counter-clockwise toward print wheel 13 by the lateral movement of rocking lever 26 on first printing cam surface 5*a*. As the carriage continues to the right, a second upwardly-facing, inclined surface 5*b* (FIG. 4), formed on the reverse side of each cam tooth 5, causes rocking lever 26 to rotate vertically against the force of spring 26*b* (FIG. 2), thereby allowing hammer support 23 to return to its initial position under the force of spring 28.

As best seen in FIG. 10, an ink roller 29, is mounted within a cartridge 29*a* and is carried on shift lever 18 and is continuously engaged with the printing surfaces of print belt 14.

Rotation of print wheel 13 and movement of carriage 10 along platen 91 are accomplished by means of a first double-helical worm gear 30 and a second double-helical worm gear 40 which are mounted on frame 1 and which lie parallel to carriage guide rail 2. Worm gears 30 and 40 both mesh with print wheel gear 12 (on carriage 10) and, when rotated at different angular velocities, turn print wheel 13 to select a desired print character. As will be described later, worm gears 30 and 40 also move carriage 10 along the print line and return the carriage to its home position; at the latter time worm gear 40 powers the feeding of paper.

Figure 8A:
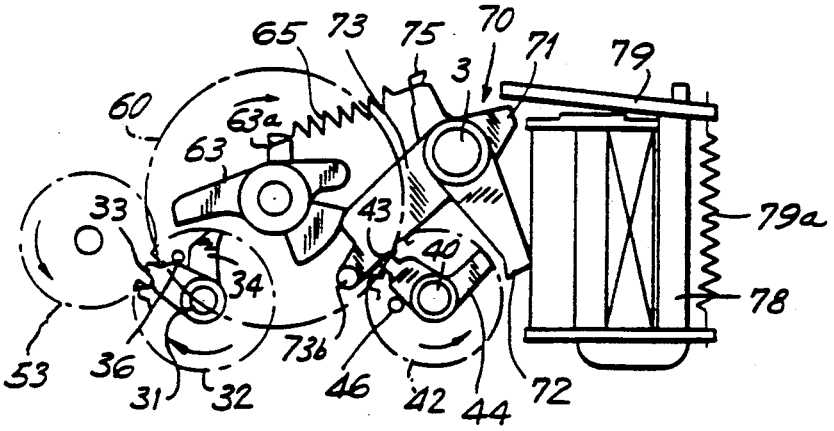
FIG. 8(*a*), 8(*b*), and 8(*c*) are end views respectively illustrating operation of the control lever of the printer to select a print character, print a character on a print line, and return the carriage to its home position.
Figure 8B:
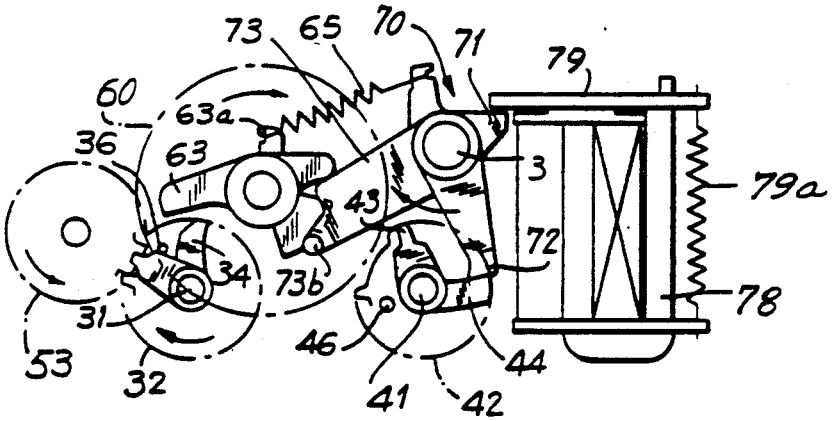
Figure 8C:
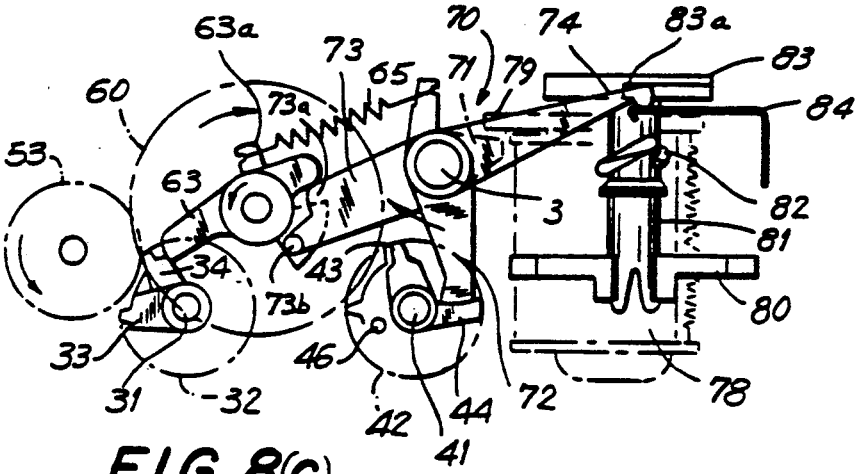

First and second drive shafts 31 and 41 of worm gears 30 and 40, respectively, are journalled in frame 1 and protrude therefrom at the left of the frame as viewed in FIG. 1. As shown in FIGS. 2 and 8, drive shafts 31 and 41 are driven by incompletely toothed or segmented worm drive gears 32 and 42, respectively. Segmented worm drive gears 32 and 42 each lack one tooth. First worm drive gear 32 meshes with a first intermediate gear 53 which is coupled to and rotates with a second intermediate gear 52 (FIG. 2). Coupled gears 52 and 53 are mounted on shaft 54 supported on frame 1. Second intermediate gear 52 is driven by a drive gear 51 which is turned by the shaft of an electric motor 50. Worm drive gear 42, on second worm shaft 41, is driven from second intermediate gear 52 via a timing gear 60. Timing gear 60 has twice the number of teeth as worm drive gear 42. Power is thus transmitted from drive motor 50 to worm drive gears 32 and 42 so as to rotate them at different speeds and clockwise and counter-clockwise, respectively. Toothed levers 34 and 44, which each respectively have one tooth 33, are shaped to make up for the missing teeth in the toothless portions of incompletely toothed worm drive gears 32 and 42. Toothed levers 34 and 44 are rotatably mounted on portions of worm gear shafts 31 and 41 which project beyond the worm drive gears. Springs 35 and 45 respectively urge first toothed lever 34 and second toothed lever 44 clockwise and counter-clockwise against stop pins 36 and 46 which are respectively carried on worm drive gears 32 and 42, into position so as to fill in for the missing teeth.

Withdrawal of toothed levers 34 and 44 from the toothless regions of segmented gears 32 and 42 is controlled by an operating control lever 70, directly, in the case of toothed lever 44, or indirectly via a return lever 63, in the case of toothed lever 34. Control lever 70 is pivotally mounted on shaft 3 which is fixed to frame 2 and has five control arms (best seen in FIGS. 2, 5 and 8(*c*)). Activator arm 71 extends into the path of a trigger lever 79 which is also the armature of a trigger electromagnet 78. When the electromagnet 78 is energized, trigger lever 79 is moved against the force of spring 79*a* so that actuator arm 71 rotates control lever 70 clockwise. One control arm 72 of control lever 70 can thus be moved into the path of rotation of second toothed lever 44 to engage it and to thereby withdraw tooth 43 from the toothless region of worm drive gear 42. Further rotation of control lever 70 is produced when pin 73*b* on a second control arm 73 of the lever is driven further by a cam 61 (FIGS. 5 and 6) which is formed on the back of timing gear 60. Shoulder 73*a* (FIG. 8(*c*)) of arm 73 then rotates return lever 63 counterclockwise to intercept single-tooth lever 34 and thereby effects disengagement of first segmented worm drive gear 32 from intermediate drive gear 53. At the same time, third control arm 74, (FIGS. 2, 5 and 8(*c*)) presses against a lock lever 84 which interacts with recess 83*a* in paper feed drive disc 83 (See FIGS. 2 and 3) to stop rotation of paper feed drive shaft 81. The tip of a fourth control arm 75 receives energy for returning control lever 70 counter-clockwise from coil spring 65 which stretches from a hook 63*a* on return lever 63.

Figure 5:
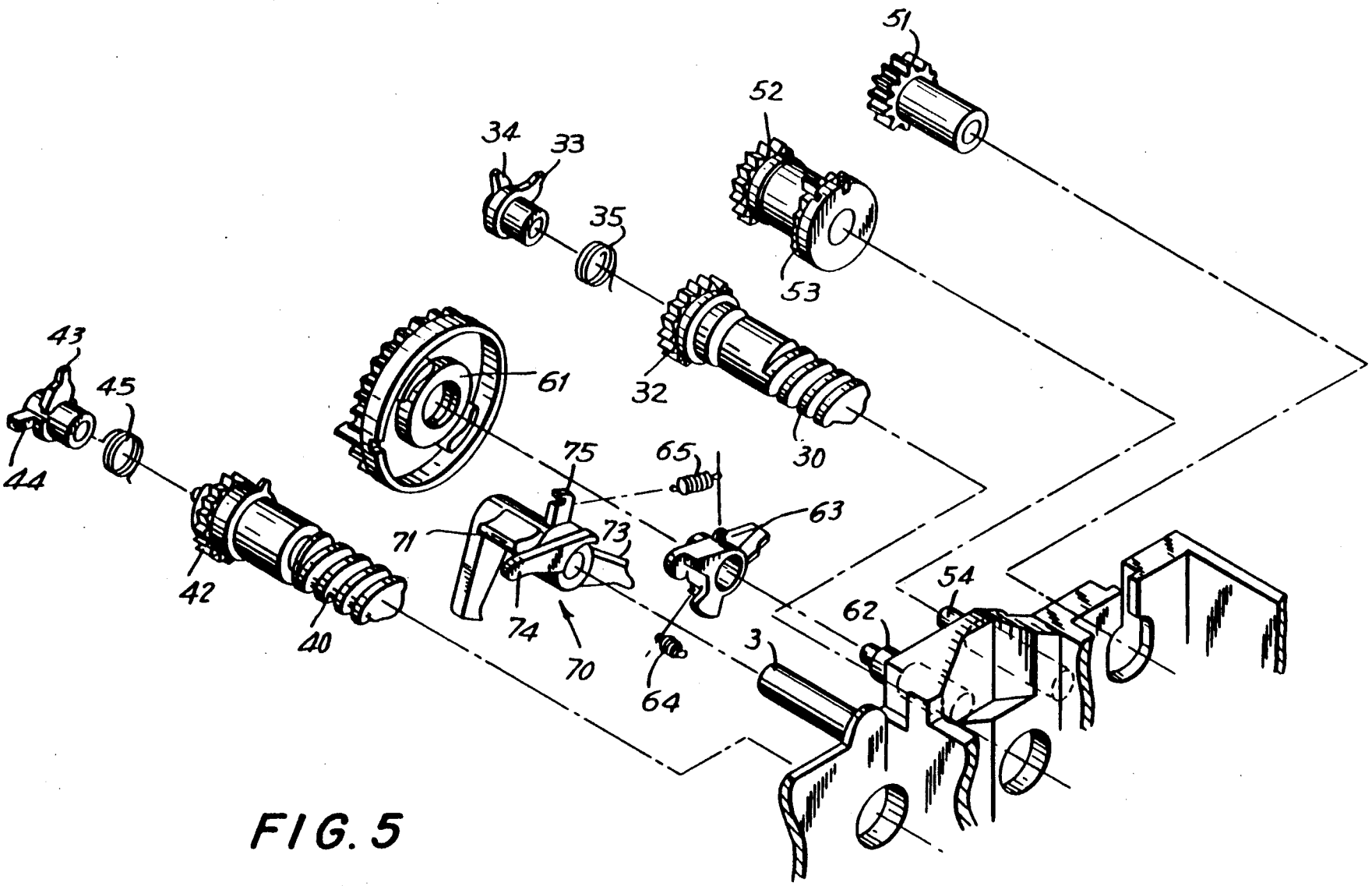
FIG. 5 is an exploded view of the power-transmitting drive mechanism of the printer.

The construction of cam 61 on the back surface of timing gear 60 is shown in FIGS. 5 and 6, where the manner in which pin 73*b*, carried at the outer end of control arm 73 (not visible in FIGS. 5 and 6), bears on the cam, can also be seen. Timing cam 61 is generally elliptic in overall form, but contains two grooves 61*c* across its major axis through either of which pin 73*b* can pass. When trigger lever 79 is actuated by electromagnet 78 and presses against control lever 70, pin 73*b* slides along the surface of cam 61 which extends from either of the points 61*a* on the major axis of the ellipse, to the next point 61*b* which lies on the minor axis. Grooves 61*c* of cam 61 are designed so that, when trigger electromagnet 78 is energized for an extended period which is twice the normal period, e.g., the time required for timing gear 60 to rotate through 180°, pin 73*b* is allowed to fall into the next (viewed as clockwise in FIG. 6) groove 61*c* so that control lever 70 is further rotated.

When return lever 63 is engaged by control lever arm 73, first toothed lever 34 is withdrawn from its position in the toothless region of first segmented drive gear 32. Return lever 63 is both rotatably and slidably mounted on shaft 62 of timing gear 60. The sliding movement of return lever 63 is controlled by movement of carriage 10. When carriage 10 is at the starting point of a print line, e.g., the left most position as seen in FIG. 1, protrusion 76, which is formed on the left-hand end of carriage 10 (FIGS. 2, 9(*c'*) and 9(*d'*)), pushes against return lever 63, causing it to slide outward against the force of return spring 64 (FIG. 9). Return lever 63 is then free to turn until its bottom surfaces rest on the tops of a pair of steps 4 which are formed on the adjacent outside surface of frame 1 (FIGS. 2 and 9). In this condition, return lever 63 is not in engagement with first toothed lever 34, leaving lever 34 free to return its tooth into the tooth gap of first worm drive gear 32. When return lever 63 is urged counter-clockwise by control arm 73, it rotates off of steps 4 and moves inwardly against frame 1. In this position it is in engagement with, and again blocks rotation of, first toothed lever 34, preventing the driving of first worm gear 30.

The paper-feed mechanism of the printer is best seen in FIGS. 1, 2, 3, and 7. The paper feed mechanism has a vertical worm shaft 81 which carries a segmented helical tooth made up of three helical elements 82 which are spaced 90° from each other on a circle. The helical tooth thus extends three quarters of the way around worm shaft 81. Worm shaft 81 is located out of the path of carriage 10. Rotary driving force for feeding the paper is transmitted to worm shaft 81, paper feed shaft 81 from second worm gear 40 via a segmented paper feed drive gear 80 (FIGS. 1 and 2) which is attached to the lower end of shaft 81. A lock lever 84 acts on a retaining portion 83*a* of a disk 83 which is carried on shaft 81 to prevent rotation of the toothless portion of segmented paper feed drive gear 80 into engagement with second drive worm 40. When control lever 70 (FIG. 8(*c*)) has been fully rotated through a large angle, control arm 74 comes down lock lever line 84, pushing it out of engagement with disc 83. The force of coil spring 89, acting between frame 1 and disk 83, rotates disk 83 to bring the teeth of paper feed drive of 80 into mesh with second drive worm 40. Drive gear 80 is thus driven in rotation and helical tooth 82 turns roller drive gear 87, rotating shaft 86 and causing roller 85 to move the paper to the next print line.

The printer further includes a pressure roller 88 (FIG. 2) which rolls against paper-feed roller 85, a set of parallel fins which form a surface 90 on the frame for guiding the paper, and platen 91 which is supported opposite print wheel 13 and which provides a surface against which paper can be pressed by print wheel 13. The location of the paper in front of the platen is shown by the dashed line in FIG. 4. A rotary encoder wheel 92 is driven from first worm 30 and rotates in synchronism with it as shown in FIGS. 1-3 to actuate encoder contacts 93 which are supported on mounting plate 94.

The manner in which the printing apparatus of the invention operates is described below.

Selection of Print Characters

During selection of a print character, trigger electromagnet 78 is not energized and, as shown in FIG. 8(*a*), control lever 70 is urged counter-clockwise by spring 65. Therefore, control arm 72 of lever 70 lies outside of the path of second toothed lever 44 and third control arm 73 is out of contact with return lever 63. Thus, first and second toothed levers 34 and 44 rest against stops 36 and 46, respectively, and their teeth 33 and 43 fill in the gaps in segmented worm drive gears 32 and 42. Accordingly, first worm 30 receives rotary driving force which is transmitted from drive gear 51, via intermediate gears 52 and 53, to first segmented worm driving gear 32 and second worm gear 40 receives rotary driving force transmitted from drive gear 51, via intermediate gear 52 and timing gear 60, to second segmented worm drive gear 42. Print wheel 13 is rotated by the difference in rotating speeds of worm gears 30 and 40 until a desired print character 15 is positioned opposite the surface of platen surface 91. Meanwhile, since print wheel gear 12 has been continuously meshed with worm gears 30 and 40, carriage 20 remain stationary relative to frame 1.

Movement Along a Print Line and Printing

When a desired print character 15 has been selected, trigger electromagnet 78 is energized for the amount of time required for timing gear 60 to make one quarter of a revolution. As shown in FIG. 8(*b*), trigger lever 79 is attracted by electromagnet 78 and causes first control arm 70 to be turned clockwise by pressing on actuator arm 71. This causes control arm 72 to move into the path of rotation of second toothed lever 44, stopping its rotation. As a result, tooth 43 of tooth lever 44 is withdrawn from the toothless region of second segmented worm drive gear 42, worm gear 42 comes out of mesh with timing gear 60, and rotation of worm 40 stops. At this time, return lever 63 is not engaged by operating arm 73 of control lever 70, even though the control lever has rotated in the direction which could bring this about, because return lever 63 remains seated, out of the way, on steps 4 of frame 1. First toothed lever 34 is therefore free and first segmented worm drive gear 32 continues to rotate.

Print wheel gear 12 is thus still driven by first worm gear 30 and rolls like a pinion on second worm gear 40 which is not turning and which serves as a rack on which gear 12 can travel. During one turn of first worm gear 30, carriage 10 is moved to the right by the force of worm gear 30 acting on print wheel gear 12 and thus on its shaft 17, into the next print position. During this motion, print wheel gear 12 rotates very little. At the same time, rocking lever 26 is moved laterally by tooth 5*a*, out of rack 5, and impels hammer support lever 23 counter-clockwise. Then tip 24*a* of hammer 24, which is at the tip of lever 23 and is biased to the right by spring 28*a*, is now impacted against the rear surface 16 of the selected print character 15. Print character 15, which has been inked by passage over ink roller 29, strikes the paper.

The impacted condition continues until rocking lever 26 has passed tooth 5*a* of rack 5. During the period of impact, print wheel 13 continues to turn clockwise and hammer 24 moves with it, pivoting in recess 23*a* of lever 23 to maintain hammer tip 24*a* in contact against the back 16 of print character 15. Character 15 is thus pressed and rolled against the paper, insuring that a clear image of the print character, numeral, or the like, is printed on the paper.

As carriage 10 continues to move to the right, tip 26*a* of rocking lever 26 begins to fall back between teeth 5*a* of rack 5. The force of spring 28 now acts to turn hammer lever 23 clockwise, moving hammer tip 24*a* away from the back surface of print character 15. Hammer 24 is now rotated counter-clockwise by spring 28 and returns to the condition shown in FIG. 4, ready for the next printing stroke.

Meanwhile, timing gear 60 has made the quarter revolution described above and pin 73*b*, at the tip of operating arm 73 (FIG. 6), has moved from point 61*b*, which lies on the major axis of elliptical cam 61, to point 61*b* which lies on the minor axis. When trigger magnet 78 is deenergized at the completion of the quarter turn, pin 73*b* moves away from cam surface 61 and follows the path marked by arrow A, avoiding falling into groove 61*c*. At the same time control level 70 has been rotated counter-clockwise by action of spring 65 and returned to its original position. Second toothed lever 44 also resumes its original position, placing its tooth in the toothless region of second segmented worm drive gear 42. Second worm drive gear 42 now meshes with timing gear 60. Both worm gear 30 and worm gear 40 are again rotating and the apparatus is ready to select the next print character.

Carriage Return and Paper Feed

When carriage 10 has travelled the full length of a print line, or when the need to move to another line arises during the printing process, trigger electromagnet 78 is energized for a period of time which is twice as long as the time required for moving carriage 10 along a print line, i.e. the time which is required for timing gear 60 to rotate through 180°. Control lever 70, against which trigger lever 79 of electromagnet 78 is pressed, rotates clockwise as it did in the operation described above, and control arm 72 again prevents rotation of second toothed lever 44 so that the transmission of rotary motion to second worm gear 40 is interrupted.

During the first quarter turn of timing gear 60, pin 73*b*, at the tip of control arm 73, moves from point 61*a*, on the major axis of elliptic cam 61, to point 61*b*, on the minor axis (FIG 6). As timing gear 60 continues to turn in the second quarter turn, pin 73*b* enters groove 61*c* as indicated by the arrow B in FIG. 6, and control lever 70 is now moved further, clockwise, than it was in the preceding example. As shown in FIG. 8(*c*), the resulting movement of control lever 70 brings shoulder 73*a* of third control arm 73 to press against 63, rotating it counterclockwise. Now, as shown in FIG. 9(*a*), return lever 63, which has been seated on steps 4 of frame 1, rotates out off of the steps and drops, under the force of spring 64, against frame 1 (FIG. 9(*b*)), allowing the tip of return lever 63 to move into the path of toothed lever 34, stopping its rotation (FIG. 8(*c*)). With tooth 33 of return lever 34 withdrawn from the toothless portion of first segmented worm drive gear 32, the transmission of rotary motion to worm 30 from intermediate gear 53 is interrupted.

This condition endures, even after timing gear 60 has rotated through 180° and trigger electromagnet 78 has been deenergized and after pin 73*b*, at the tip of third lever 73, escapes from groove 61*c* in cam 61, freeing selector lever 70 to be turned counter-clockwise by the pull of spring 65. This frees second toothed lever 44 of constraint and its tooth 43 returns to the toothless region of second segmented worm drive gear 42. Gear 42 again meshes with timing gear 60 and transmits rotary power to second worm gear 40.

Since first worm gear 30 is still kept stationary, print wheel gear 12 now receives a rotary driving force from second worm gear 40 which is opposite in direction from that previously received. Print wheel gear 12 now rolls on first worm gear 30 and the thrust transmitted to print wheel gear shaft 25 causes carriage 10 to return to its home position at FIG. 1. When carriage 10 arrives at the home position, protrusion 76, on the left end of carriage 10, pushes out through hole 6 in frame 1 and moves return lever 63 away from the frame so that it turns under the influence of spring 65 and reseats itself on steps 4 (FIGS. 9(*c*) and (*d*)). Return lever 63 thus releases second toothed lever 44 which now returns to its original state as shown in FIG. 8(*a*). Rotary motion of first worm gear 30 is restarted.

While carriage 10 has been moving back to its home position, rocking lever 26 (FIG. 4) passes over inclined surfaces 5*b* on the reverse sides of the teeth of rack 5, swinging upwards about shaft 27 as it goes. The return action of the carriage is thus smoothly accomplished without driving hammer support 23.

Feeding of paper during carriage return is accomplished as follows. When control lever 70 is moved clockwise by pin 73*b* in the last part of its full travel, the tip of control arm 71 contacts and pushes lock lever 84 downward, disengaging lock lever 84 from recess retaining portion 83*a* in disk 83 (FIG. 8(*c*)). Disk 83 is then free to turn, under the pull of spring 89, to bring segmented paper-feed gear 80 into engagement with the helical teeth of second worm gear 40, which it has heretofore not engaged. With the release of control lever 70 by cam 61, rotation of second worm gear 40 is restarted. The driving of segmented paper-feed wheel 80 second worm gear 40 causes helical segment 82 to turn helical gear 87 which rotates paper feed roller shaft 86. Paper-feed roller 85 now moves the paper into position for receiving the next line of print. This operation continues until carriage 10 returns to its home position, whereupon segmented paper-feed wheel 80 is disengaged from second worm gear 40 by virtue of the presence of its toothless region. Now, paper feed wheel 80 is again held against rotation by lock lever 84, preventing the feeding of paper.

Print Wheel Shift

When carriage 10 is being restored to its home position by the return operation described above, first protrusion 21*a*, (FIG. 10) which extends perpendicularly from shift lever 18, strikes projection 7 which lies on frame 1 at a point immediately before the home position (FIG. 1 and 10). Continued motion of carriage 10 causes shift lever 18 to turn clockwise about sleeve 17, with its depending projections 19 riding on upwardly inclined surfaces 22*a* of cams 22. Shift lever 18 is forced upward by top surfaces 22*a* as it continues to rotate. As it rises, shift lever 18 raises print wheel 13 to position symbol print wheel 13*b* at the location which has previously been occupied by numeral print wheel 13*a*, e.g., at the level of the print line (FIG. (10*b*')).

While symbols print wheel 13*b* is at the level of the print line, the operations for selecting print characters and for printing characters on the next print line are repeated as carriage 10 again moves from its home position to the right. After carriage 10 has moved three or four print positions from the starting point of the print line, e.g., after the carriage has moved past the two or three print positions at which symbols are ordinarily printed, second protrusion 21*b*, which has been rotated to its laterally extending position as a result of rotation of lever 18, comes to bear on projection 7 of frame 1 (FIG. 10(*b*) and motion of the carriage continues, causing shift lever 18 to turn counter-clockwise (FIG. 10(*c*)). Shift lever 18 then is lowered by the action of inclined surfaces 22*a* of cams 22, and numeral wheel 13*a* is returned to the printing location ready for printing of numerals.

In the processes described above, the operations for selecting print characters, printing characters on the print line, returning the carriage, and feeding paper are carried out using two oppositely-rotating worm gears. It will be understood that the same operations may be carried out by means of oppositely directed helices on worm gears which are turning in the same direction.

As described above, the novel apparatus of the invention utilizes a gear for rotating a print wheel which is meshed with two worm gears. The worms are selectively caused to rotate and to stop by means of a control device to: permit selection of print characters on the print wheel by rotating the two worm gears simultaneously; move the carriage along a print line by halting one worm gear; and return the carriage to its home position by halting the other worm gear. In this way, the operations of the printer are simply controlled by selective actuation of only the two worm gears while the motor which drives them rotates at all times in the same direction. The mechanism of the printer is thus greatly simplified. Further, there is no need to move the carriage along a print line against the force of a return spring or the like. Consequently, the size of the drive motor and its associated components, which have heretofore occupied a large space and which account for a considerable portion of the price of the printer, is substantially reduced. Thus, the size of the whole printer is minimized, the printer costs less, and the printer uses less electric power.

Further, since the worm wheel which meshes with the two worm gears is integral with the print wheel, the motion of the print wheel is under complete control. The positions of print characters, therefore, are always accurately located. Using simple detecting means, the number of turns made by the driving worm is easily counted so that the angular position of the print wheel is easily established and greatly simplifed circuits for controlling these operations may be used. Since the head of the print-character hammer is actuated for printing character by a toothed cam surface which is disposed parallel to the driving worms, characters are printed simultaneously with the shift of the carriage along the print line, permitting a substantial reduction in the time taken to print characters. Finally, since characters are printed while the print wheel is rolling, vivid printed images are formed on the printing medium.

It will thus be seen that the objects set forth above, among those made apparent from the preceding description, are effectively attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing apparatus, comprising:

a platen;

frame means for supporting the platen and including a projection;

carriage means supported on the frame for motion along a path parallel to the platen and including at least one cam surface, said projection on said frame means being positioned adjacent to the path of said carriage means;

print wheel means having at least two levels of print type and rotatably mounted on said carriage means in front of the platen; and print wheel shift means coupled to said print wheel means and said carriage means and responsive to the position of said carriage means along said path for shifting the position of said print wheel means between different levels of print type based on engagement of said print wheel shift means with said cam surface of said carriage means.

2. The printing apparatus of claim 1, wherein said carriage means travels in reciprocating directions along said path and in which said print wheel shift means includes first means for intermittent contact with said projection of said frame means as said carriage means travels in a first of said reciprocating directions whereby the print wheel means is shifted from a first position corresponding to one of two levels of print type to a second position corresponding to the other of two levels of print type, and second means for intermittent contact with said projection of said frame means as said carriage means travels in a second of said reciprocating directions whereby the print wheel means is shifted from the second position to the first position.

3. The printing apparatus of claim 1, further including inking means positioned on the print wheel shift means for inking each level of print type.

4. A printing apparatus, comprising:

a platen;

frame means for supporting the platen and including a projection;

carriage means supported on the frame for motion along a path parallel to the platen and including at least one cam surface, said projection on said frame means being positioned adjacent to the path of said carriage means;

print wheel means having at least two levels of print type and rotatably mounted on said carriage means in front of the platen; and print wheel shift means coupled to said print wheel means and responsive to intermittent contact with said projection on said frame means as said print wheel shift means travels by said projection for shifting the position of said print wheel means between different levels of print type based on engagement of said print wheel shift means with said cam surface of said carriage means;

5. The printing apparatus of claim 4, wherein said carriage means travels in reciprocating directions along said path and in which said print wheel shift means includes first means for intermittent contact with said projection of said frame means as said carriage means travels in a first of said reciprocating directions whereby the print wheel means is shifted from a first position corresponding to one of two levels of print type to a second position corresponding to the other of two levels of print type, and second means for intermittent contact with said projection of said frame means as said carriage means travels in a second of said reciprocating directions whereby the print wheel means is shifted from the second position to the first position.

6. The printing apparatus of claim 4, further including inking means positioned on the print wheel shift means for inking each level of print type.

* * * * *